US008194382B2

(12) United States Patent
Ellis et al.

(10) Patent No.: US 8,194,382 B2
(45) Date of Patent: Jun. 5, 2012

(54) METHOD AND APPARATUS FOR DRIVING A SWITCH

(75) Inventors: Denis Ellis, Patrickswell (IE); Raymond Goggin, Watergrasshill (IE)

(73) Assignee: Analog Devices, Inc., Norwood, MA (US)

( * ) Notice: Subject to any disclaimer, the term of this patent is extended or adjusted under 35 U.S.C. 154(b) by 394 days.

(21) Appl. No.: 11/962,865

(22) Filed: Dec. 21, 2007

(65) Prior Publication Data

US 2008/0151464 A1 Jun. 26, 2008

Related U.S. Application Data

(60) Provisional application No. 60/871,619, filed on Dec. 22, 2006.

(51) Int. Cl.
*H01H 47/26* (2006.01)

(52) U.S. Cl. ..... 361/211

(58) Field of Classification Search ..... 361/211
See application file for complete search history.

(56) References Cited

U.S. PATENT DOCUMENTS

| | | | | |
|---|---|---|---|---|
| 2,664,618 | A | 1/1954 | Kleis | 29/182.5 |
| 4,674,180 | A | 6/1987 | Zavracky et al. | 29/622 |
| 4,764,244 | A | 8/1988 | Chitty et al. | 216/20 |
| 4,959,515 | A | 9/1990 | Zavracky et al. | 200/181 |
| 5,245,501 | A * | 9/1993 | Locher et al. | 361/154 |
| 5,638,946 | A | 6/1997 | Zavracky | 200/181 |
| 6,091,125 | A | 7/2000 | Zavracky | 257/417 |
| 6,153,839 | A | 11/2000 | Zavracky et al. | 200/181 |
| 6,483,395 | B2 | 11/2002 | Kasai et al. | 333/105 |
| 7,202,764 | B2 | 4/2007 | Deligianni et al. | 335/78 |
| 7,256,669 | B2 | 8/2007 | Morrison, Jr. et al. | 335/78 |
| 2002/0088112 | A1 | 7/2002 | Morrison, Jr. et al. | 29/622 |
| 2004/0040828 | A1 * | 3/2004 | Ivanciw et al. | 200/600 |
| 2004/0151032 | A1 * | 8/2004 | Polansky et al. | 365/189.05 |
| 2004/0201556 | A1 * | 10/2004 | Oomori et al. | 345/76 |
| 2005/0212597 | A1 * | 9/2005 | Tsuchi | 330/253 |
| 2005/0258458 | A1 * | 11/2005 | Wang et al. | 257/272 |
| 2006/0120004 | A1 | 6/2006 | Thiery et al. | 361/118 |

FOREIGN PATENT DOCUMENTS

| | | |
|---|---|---|
| CN | 1679130 A | 10/2005 |
| EP | 1 146 532 A2 | 10/2001 |
| GB | 645681 | 11/1950 |
| JP | 2001-179699 | 7/2001 |
| JP | 2005-536854 | 12/2005 |

(Continued)

OTHER PUBLICATIONS

Satya P. Sharma et al. "*Oxidation of Ruthenium*," IEEE Transactions on Components, Hybrids, and Manufacturing Technology, vol. CHMT-6, No. 1, pp. 89-92, Mar. 1983.

(Continued)

*Primary Examiner* — Jared Fureman
*Assistant Examiner* — Scott Bauer
(74) *Attorney, Agent, or Firm* — Sunstein Kann Murphy & Timbers LLP

(57) ABSTRACT

A method of driving a switch having a movable member and a contact first applies (to the switch) a first signal having a first level, and then applies a second signal having a second level to the switch (after applying the first signal). The first level is greater than the second level. One or both of the first and second signals cause the movable member to move to electrically connect with the contact.

5 Claims, 10 Drawing Sheets

FOREIGN PATENT DOCUMENTS

| | | | |
|---|---|---|---|
| KR | 10-2005-0039867 | | 4/2005 |
| TW | 543292 | B | 7/2003 |
| WO | WO 2005/006372 | A1 | 1/2005 |

OTHER PUBLICATIONS

Eung-Jik Lee et al. "*Reactive Ion Etching Mechanism of $RuO_2$ Thin Films in Oxygen Plasma with the Addition of $CF_4$, $Cl_2$, and $N_2$*," Japanese Journal of Applied Physics, vol. 37, Pt. 1, No. 5A, pp. 2634-2641, May 1998.

Paul C. Hydes "*Electrodeposited Ruthenium as an Electrical Contact Material: A Review of its Properties and Economic Advantages*," Ullmann's Encyklopadie on Platinum, vol. 18, pp. 50-55, 1979.

Hiroaki, Samata et al. "*Crystal Growth and Properties of New Ruthenium Oxides*," J. Phys. Chem. Solids, vol. 59, No. 9, pp. 1445-1452, 1998.

J. Kristóf et al. "*Investigation on the Formation of $RuO_2$ Film Electrode by Secondary Ion Mass Spectrometry*," Surface Science vol. 348, pp. 287-298, 1996.

T. Yokokawa et al. "*Thickness of Ruthenium Oxide Film Produced by the Surface Deactivation Treatment of Ruthenium-Plated Contact Reed Switches*," Proc. of the 35$^{th}$ Relay Conf., pp. 177-181, 1987.

J.Y. Shen et al. "*An ESCA Study of the Interaction of Oxygen with the Surface of Ruthenium*," Applied Surface Science, vol. 51, pp. 47-60, 1991.

R.G. Vadimsky et al. "*Ru and $RuO_2$ as Electrical Contact Materials: Preparation and Environmental Interactions*," J. Electrochem. Soc.: Solid-State Science and Technology, vol. 126, No. 11, Nov. 1979.

S.P. Sharma et al. "*Environmental Interactions of Ruthenium*," Proc. 11$^{th}$ Int. Conf. Electrical Contact Phenomena, pp. 290-293, Jun. 7-11, 1982.

Authorized Officer Luc Findeli *International Search Report and Written Opinion of the International Searching Authority*, International Searching Authority, International Application No. PCT/US2006/038313, Jan. 15, 2007, 7 pages.

Authorized Officer Ellen Moyse *International Preliminary Report on Patentability*, PCT/US2006/038313, Apr. 8, 2008, 4 pages.

Communication Pursuant to Article 94(3) EPC; Application No. 07 869 778.6 —2214, Jun. 28, 2010.

U.S. Appl. No. 09/419,422 [priority to JP 2001-179699], Bishop et al.

Taiwan Intellectual Property Office (TIPO), English Translation of Search Report dated Feb. 8, 2011, Application No. 096149157.

Japanese Patent Office, Japanese Official Action, Japanese application No. 2009-543270.

Shusaku Yamamoto, Translation of Japanese Official Action, Japanese application No. 2009-543270.

Kim & Chang, Translation of Notice of Preliminary Examination; Korean Patent Application No. 10-2009-7015381.

Taiwan Intellectual Property Office, English Translation of the TIPO's Search Report for ROC Patent Application No. 096149157, Nov. 2, 2011.

Ethan Huang and Joyce Ho, Translation of Office Action of Dec. 2011; ROC (Taiwan) Patent Application No. 96149157, Dec. 2, 2011.

The State Intellectual Property Office of the People's Republic of China, First Office Action (Chinese) Application No. 200780046702.1, Nov. 16, 2011.

RWS Group, Translation of First Office Action; Application No. 200780046702.1, Nov. 16, 2011.

* cited by examiner

METHOD AND APPARATUS FOR DRIVING A SWITCH

PRIORITY

This application claims priority from the following United States provisional patent application, which is hereby incorporated herein by reference in its entirety:

Application No. 60/871,619 filed on Dec. 22, 2006.

FIELD OF THE INVENTION

The invention generally relates to switches and, more particularly, the invention relates to controlling switches.

BACKGROUND OF THE INVENTION

Electronic devices often use electronic switches to selectively connect two portions of a circuit. One type of switch has a movable arm that alternatively touches an electrically conductive port (often referred to as a "contact") on a stationary surface. The arm typically moves in response to a drive signal that forces the arm toward the contact.

To operate with higher speed circuitry, it generally is desirable for a switch to make this connection with its contact in the shortest amount of time. Accordingly, many switches use a relatively high level signal that forces this connection with the contact in the shortest amount of time. For example, the drive signal may rise at a very rapid rate to a maximum voltage to electrostatically urge a micro electromechanical ("MEMS") cantilever arm toward the stationary contact. This rapid rate undesirably can cause the arm to physically bounce off the contact and oscillate before making a stationary contact.

In response to this, one skilled in the art may produce a lower intensity signal; e.g., one that rises slower. Although it may mitigate the bouncing problem, such a solution undesirably reduces the speed of closing the switch.

SUMMARY OF THE INVENTION

In accordance with one embodiment, a method of driving a switch having a movable member and a contact first applies (to the switch) a first signal having a first level, and then applies a second signal having a second level to the switch (after applying the first signal). The first and second levels are the rate of change of the respective signals. The first level is greater than the second level. One or both of the first and second signals cause the movable member to move to electrically connect with the contact.

A method of driving a switch having a movable member may apply one or more signals simultaneously, in sequence, or for an overlapping time. In one embodiment, the one or more signals may be voltage signals. In one embodiment, the one or more signals may be current signals.

In accordance with one embodiment, a drive signal may be produced by a circuit that supplies a voltage or an electrical current to the switch. In one embodiment, a voltage output circuit applies a voltage signal to the switch that has a first level at a first time, and a voltage signal that has a second level after applying the first voltage signal, the first and second levels are the rate of change of the respective voltage signals.

In one embodiment, a current output circuit comprises a current mirror with a current input connected to at least one current source, and a current output connected to the switch. The output of the current mirror serves as a current source to provide charging current to the switch. The current output circuit provides to the switch a first signal of charging current having a first level, and then provides a second signal of charging current having a second level after applying the first signal of charging current.

The movable member illustratively moves to electrically connect with the contact when subjected to a threshold amplitude value. Accordingly, in illustrative embodiments, the first signal has a maximum amplitude that is less than the threshold amplitude value, while the second signal has a maximum amplitude that is greater than the threshold amplitude value.

The method may operate with different types of signals. For example, the first level may be a first voltage, while the second level may be a second voltage. Among other things, the first level and second level may be the rate of increase in voltage relative to time. When executed, the method causes the movable member to move in a manner that causes it to be substantially free of oscillations after electrically contacting the contact.

The signals may be provided a number of different ways. For example, a single source may provide the first and second signals. In other embodiments, a first source provides the first signal and a second source provides the second signal. In yet other embodiments, a first and second source provide one or both of the first and second signals.

In accordance with another embodiment of the invention, a switch driver circuit has a source for delivering a signal having more than one level. Specifically, the signal has a first level, and a second level that is greater than the first level. The switch driver also has an output for delivering the signal so that the signal attains the second level after it has attained the first level.

Among other things, the source may be a plurality of sources or a single source.

BRIEF DESCRIPTION OF THE DRAWINGS

Those skilled in the art should more fully appreciate advantages of various embodiments of the invention from the following "Description of Illustrative Embodiments," discussed with reference to the drawings summarized immediately below.

FIG. 6(*b*) is a timing diagram for certain signals of the circuit in FIG. 6(*a*).

DESCRIPTION OF ILLUSTRATIVE EMBODIMENTS

In illustrative embodiments, a driver applies a drive signal to a switch in a manner that substantially mitigates oscillations while, at the same time, optimizing switch-closing time. To that end, the driver first applies a first signal having a relatively high level to the switch. Before the switch closes, however, the driver applies a second signal having a lower level than that of the first signal. Among other things, the levels may be the rate of change of the signals (e.g., the rate of change of an input voltage). Details of illustrative embodiments are discussed below.

It should be noted that specific details of the switch and certain details of the driver are for illustrative purposes only. Accordingly, discussion of these details are not intended to limit the scope of various embodiments. For example, the switch may have a non-cantilevered arm, or may be formed from non-MEMS processes.

Figure 1:
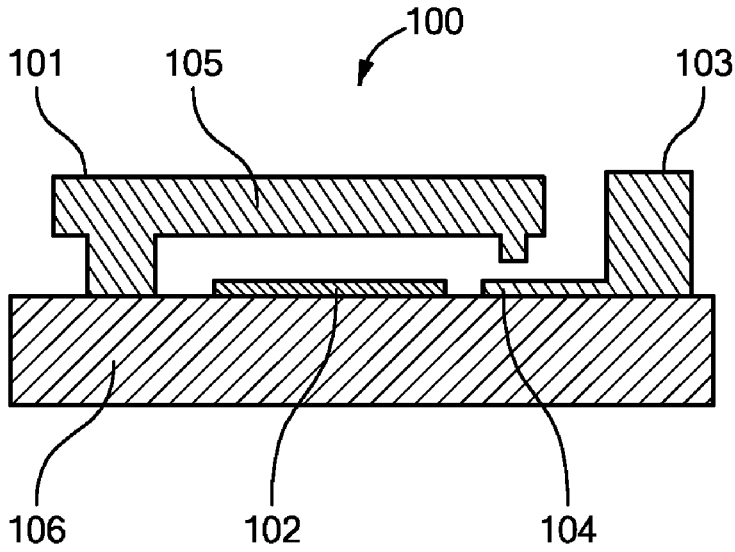
FIG. 1 schematically shows a MEMS switch in the open position.

FIG. 1 schematically shows a MEMS switch 100 according to one embodiment of this invention. The switch 100 is in the open position and has a cantilevered arm 105 for alternately making physical contact with a stationary conductor 104 which is electrically connected to a drain electrode 103. In the open position, no signal will flow from the source electrode 101 to the drain electrode 103. In this embodiment, the switch 100 is a conventional MEMS switch. In addition, the switch 100 has a stationary substrate 106 that, in addition to supporting the arm 105, also supports a gate electrode 102 that forms a variable capacitor with the arm 105. A driver (not shown in FIG. 1) is in electrical contact with the gate 102, and controls the forces applied by the variable capacitor to control arm movement.

Figure 2:
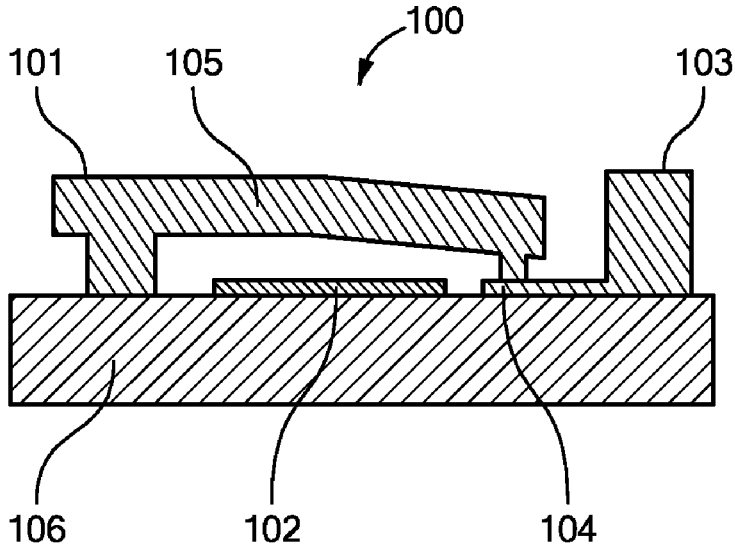
FIG. 2 schematically shows a MEMS switch in the closed position.

FIG. 2 schematically shows the switch 100 of FIG. 1 in the closed position. In the closed position, the arm 105 has moved into contact with the stationary conductor 104 that is electrically connected to a drain electrode 103. In the closed position, an electrical signal may flow from the source electrode 101 to the drain electrode 103 through the arm 105.

During operation, a driver (not shown in FIG. 2) is in electrical contact with the gate electrode 102, and applies a drive signal (the driver output) to the gate electrode 102 to selectively urge the cantilevered arm 105 into physical contact with the stationary conductor 104, thus closing a larger circuit (not shown in FIG. 2). Preferably the drive signal rises quickly enough to move the arm 105 in the shortest time, but without causing the switch 100 to bounce. Also preferably, the final level of the drive signal is sufficient to hold the arm 105 securely in the down (i.e., switch closed) position.

Figure 3A:
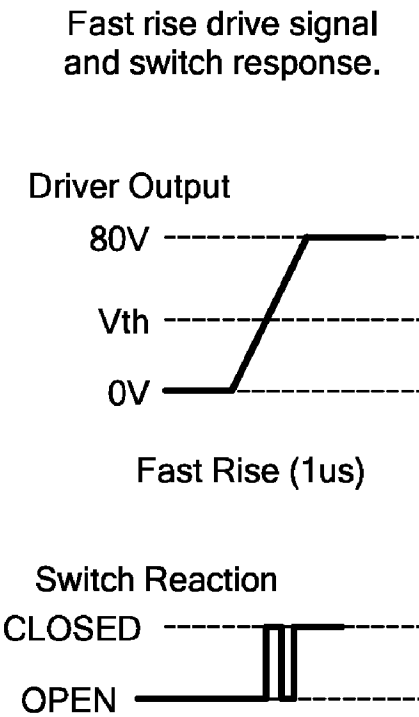
FIG. 3(*a*), FIG. 3(*b*) and FIG. 3(*c*) schematically show graphs comparing switch reaction to various drive signals.
Figure 3B:
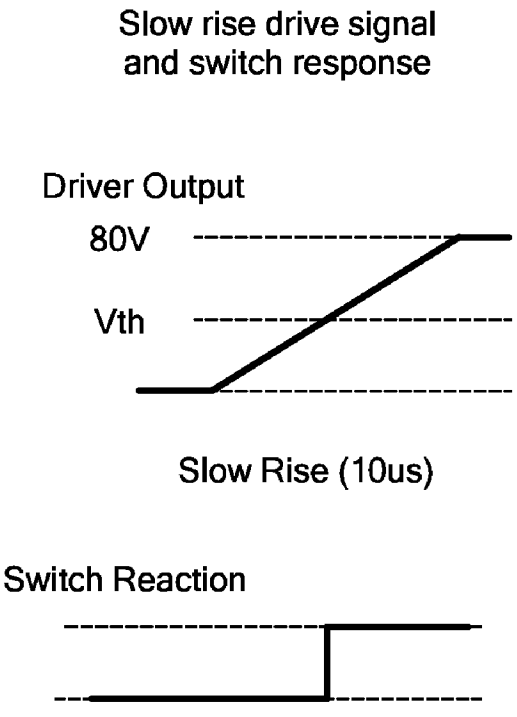
Figure 3C:
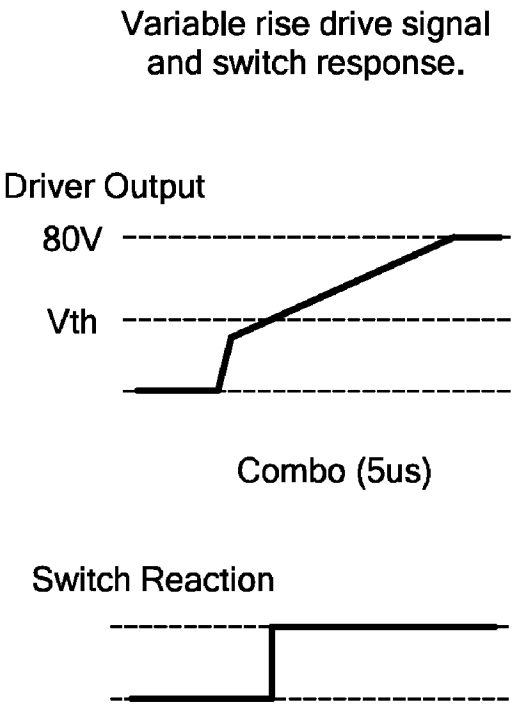

FIGS. 3(*a*), 3(*b*) and 3(*c*) show illustrative responses of an open switch 100 to various drive signals. In the upper illustration of FIG. 3(*a*), the driver output causes a fast rising voltage on the gate electrode 102. As the voltage rises, the arm 105 begins to move downward to close the switch 100, and ultimately makes contact with the stationary conductor 104 when the voltage reaches the threshold voltage (Vth). However, under this fast-rise approach the tip of the arm 105 makes contact with the stationary conductor 104 at a speed that causes the arm 105 to undesirably bounce, as shown by the oscillations in the lower illustration of FIG. 3(*a*). As the drive signal increases towards its final level (80V), the force on the arm 105 is eventually strong enough to hold the arm 105 securely in the down position (i.e., switch closed).

One approach to avoiding the bounce is to ramp the drive signal more gradually. In the upper illustration of FIG. 3(*b*), the driver output causes a more slowly rising voltage on the gate electrode 102. Again, as the applied voltage rises, the arm 105 begins to move downward to close the switch 100, and when the voltage reaches the threshold voltage (Vth), the arm 105 makes contact with the stationary conductor 104. Advantageously, the arm 105 does not bounce, as shown in the lower illustration of FIG. 3(*b*). Disadvantageously however, the time between application of the drive signal and the closing of the switch 100 in this slow-rise approach is much longer than in the fast-rise approach.

A second approach to avoiding the bounce is to ramp the drive signal at varying rates. For example, the first rate might rise rapidly towards the threshold voltage to get the arm 105 moving in a short time, but then change its rate to rise more slowly so that the final speed of the arm 105 in this approach is less than the final speed of the arm 105 in the fast-rise approach. This third approach closes the switch 100 more quickly than in the slow-rise approach, while at the same time avoiding the oscillations of the fast-rise approach. This approach is shown in the upper illustration of FIG. 3(*c*), where the gate voltage rises rapidly toward the threshold voltage, but then the rise of the gate voltage slows. Advantageously, the arm 105 does not bounce, as shown in the lower illustration of FIG. 3(*c*), but the switch 100 also closes faster than in the slow-rise approach. After this change of rate, the drive signal continues to rise to a final level, where the force exerted on the arm 105 is sufficient to hold the arm 105 securely in the down position (i.e., switch closed).

In accordance with illustrative embodiments, this drive signal is controlled to prevent the arm 105 from striking the stationary conductor 104 so hard that it will bounce upwardly after making initial contact, and yet to close the switch 100 relatively quickly. As illustrated above, striking the stationary conductor 104 with too much force can cause the arm 105 to oscillate in and out of physical contact with the stationary conductor 104. Of course, if it is not in physical contact with the stationary conductor 104, then the arm 105 is not in electrical contact with the stationary conductor 104. Accordingly, oscillations effectively delay the electrical contact of the arm 105 and stationary conductor 104. In addition, such oscillations may cause undesirable distortion to a signal passing through the switch 100, and may also reduce the reliability of the switch 100.

It should be noted that in addition to being considered a single, multi-level signal, these drive signal signals may also be considered to be multiple, independent signals.

Figure 4:
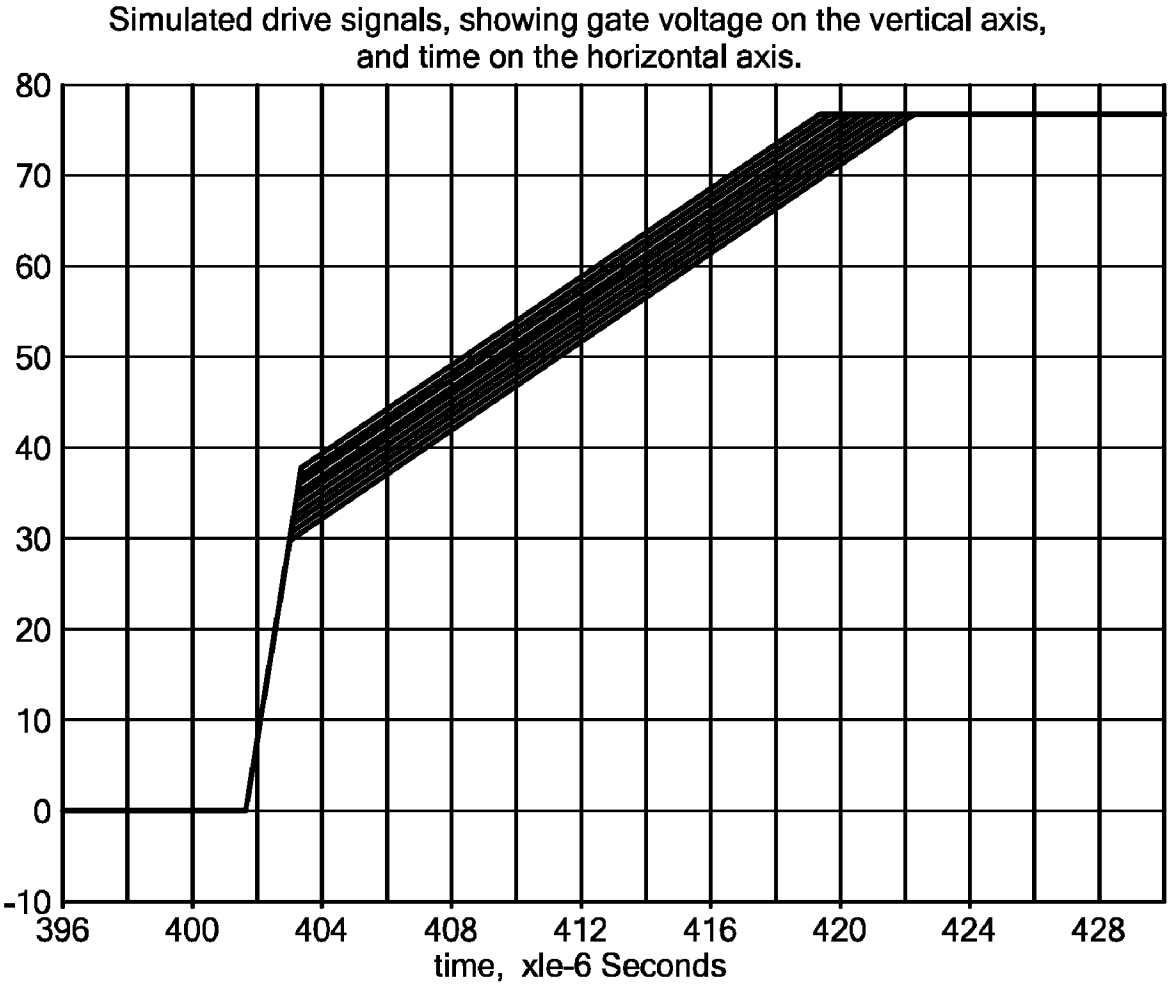
FIG. 4 is a graph of simulated drive signals.
Figure 5:
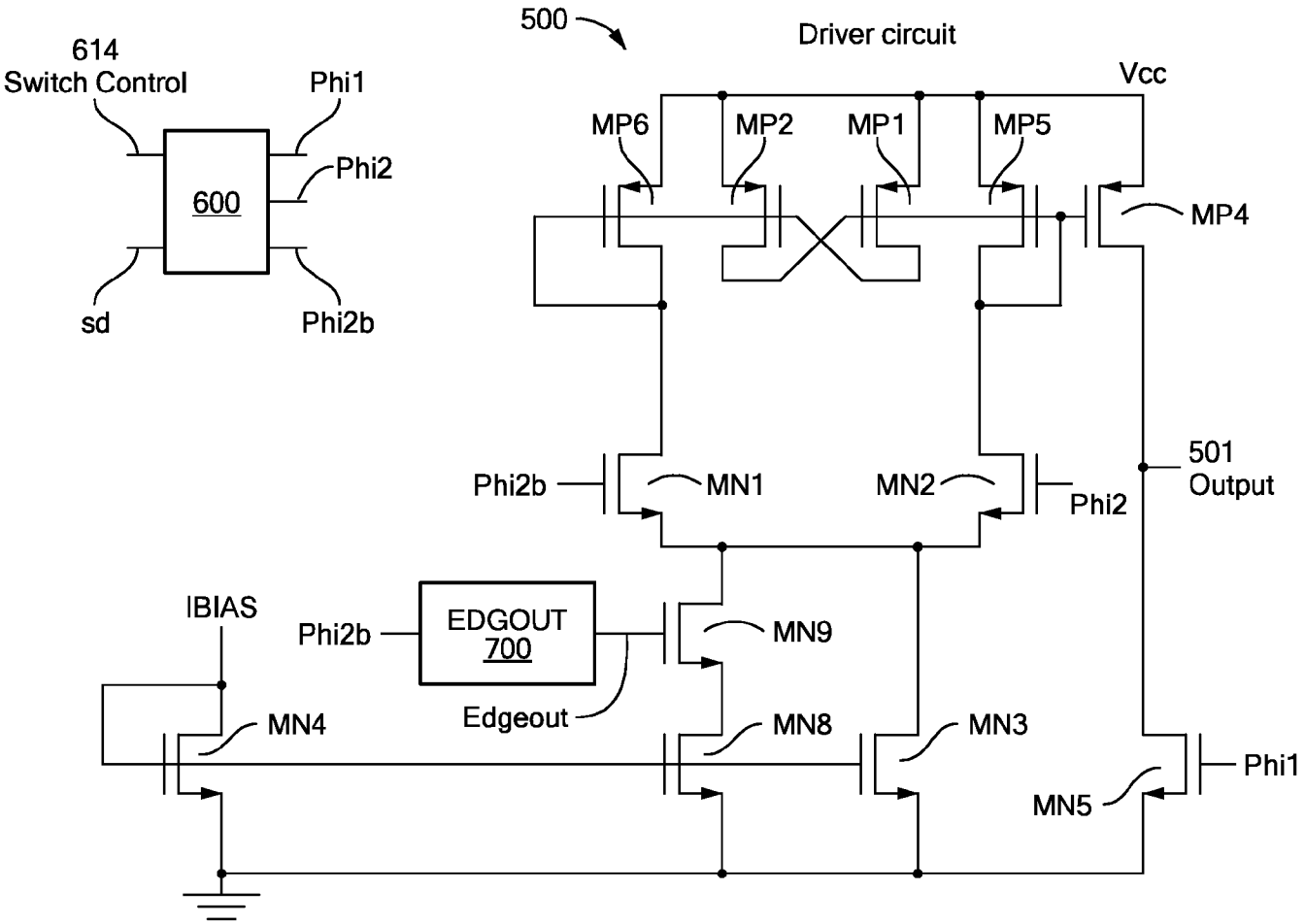
FIG. 5 is a schematic diagram of an illustrative embodiment of a circuit to drive the switch, including two digital sub-circuits.

FIG. 4 schematically shows a graphical view of various illustrative drive signal waveforms under different conditions when used with the circuit 500 shown in FIG. 5. It should be noted that these waveforms of FIG. 4 are based on a simulation and not actual tests. Accordingly, as shown FIG. 4, the drive circuit (not shown in FIG. 4) applies the first signal from zero volts to about 30 volts. As shown, the rate of the voltage increase in this amplitude is very rapid. Between amplitudes of about 30 and just below 80 volts (i.e., a rail voltage), however, the voltage increases much more gradually. These rates may be linear, variable, or both. The exact voltages applied will depend on the design and construction of the switch being controlled.

FIG. 5 is a schematic diagram of one embodiment of a circuit 500 to drive the switch. As will be more fully discussed below, the circuit 500 of FIG. 5 includes a number of transistors and other elements, and two digital sub-circuits 600 and 700 that provide various control signals to the transistors.

Figure 6A:
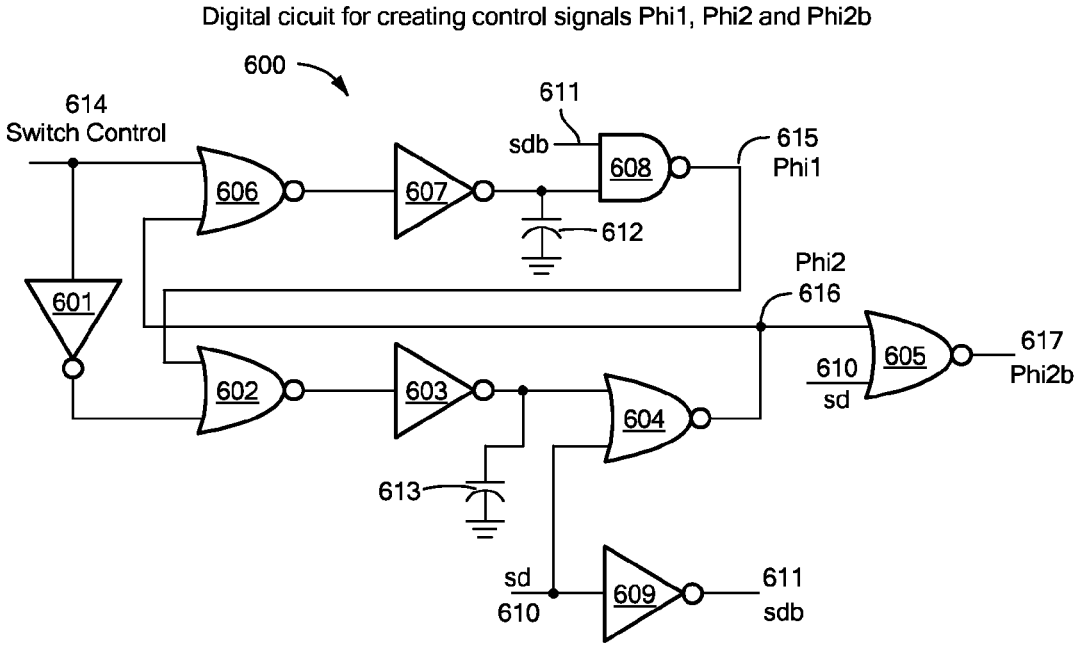
FIG. 6(*a*) is a schematic of a digital circuit for creating certain control signals.
Figure 6B:
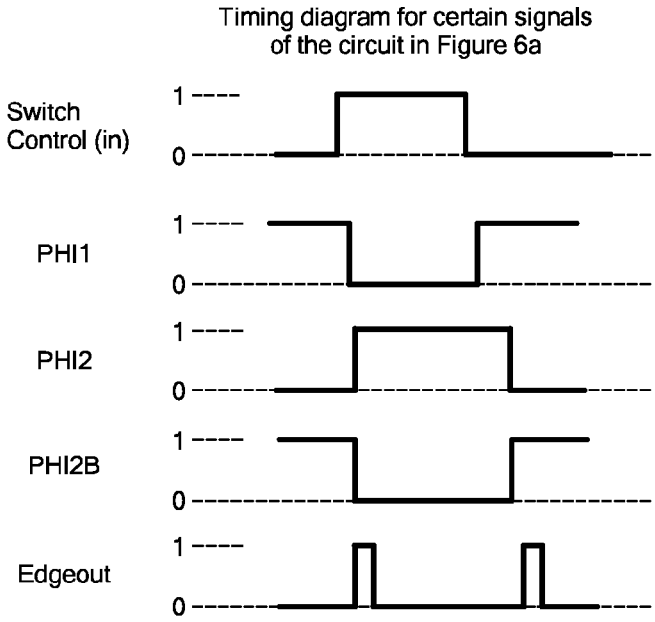

FIG. 6(*a*) is a schematic of a digital sub-circuit 600 for creating control signals Phi1 615, Phi2 616 and Phi2*b* 617. FIG. 6(*b*) shows the various signals of the circuit in FIG. 6(*a*) in response to the input Switch Control signal 614. Note that for purposes of explaining these circuits, signal "sd" 610 is held low, and therefore signal "sdb" 611 out of inverter 609 is high. As used herein in connection with the signals of digital circuits, the phrase "logic high" and "high" mean a digital logic signal of a first state, and the terms "logic low" and "low" mean a digital logic signal of a second state that is the complement of the first state.

In the circuit 600 of FIG. 6(*a*), when the switch is in the open position, the Switch Control signal 614 will be logic low. Through the inverter 601, this will cause a first input to nor gate 602 to be logic high, and thus the output of nor gate 602 to be low. Accordingly, in steady state the output of inverter 603 will be high and the output of nor gate 604 (Phi2 616) will be low. As a result, the output of nor gate 605 (Phi2*b* 617) will be high. Similarly, with Switch Control signal 614 low and Phi2 616 low, the output of nor gate 606 will be high, and the output of inverter 607 will be low. As a consequence, the output of nand gate 608 (Phi1 615) will be high. Thus at steady state with the input low and signal sd 610 low, Phi1 615 is high, Phi2 616 is low, and Phi2*b* 617 is high.

When the user desires to close the switch, the user will cause the Switch Control signal 614 to transition to a logic high. This will cause the output of inverter 601 to go low, but the other input to nor gate 602 temporarily remains high as it was before, so the output of nor gate 602 remains low, and the downstream signals temporarily remain unchanged (including Phi2 615 at logic low, and Phi2*b* 615 at logic high). In addition, the Switch Control input 614 transition from low to high means the output of nor gate 606 goes low, and thus the output of inverter 607 tries to go high. However, the output transition of inverter 607 is delayed by the need to charge capacitor 612. When capacitor 612 is charged, the output of inverter 607 will be high, and because sdb 611 is high, both inputs to nand gate 608 are high and thus the output of nand gate 608 (Phi1 615) goes low. After Phi1 615 goes low, both inputs to nor gate 602 are low, causing the output of nor gate 602 to go high. That signal causes the output of inverter 603 to start to go low, but that transition is delayed by the need to discharge capacitor 613. When capacitor 613 is discharged, the inputs to nor gate 604 will both be low, causing the output of nor gate 604 (Phi2 616) to go high and thus Phi2*b* 617 to go low. Thus, upon a transition of the input from low to high, and after a short delay due to the charging of capacitor 612, Phi1 615 goes low. Then, after a second delay due to the discharging of capacitor 613, Phi2 616 goes high, and Phi2*b* 617 goes low. In summary, when the Switch Control input 614 changes from low to high, Phi1 615 changes from high to low after a short delay, and shortly thereafter Phi2 616 transitions from low to high and Phi2*b* 617 transitions from high to low.

Figure 7:
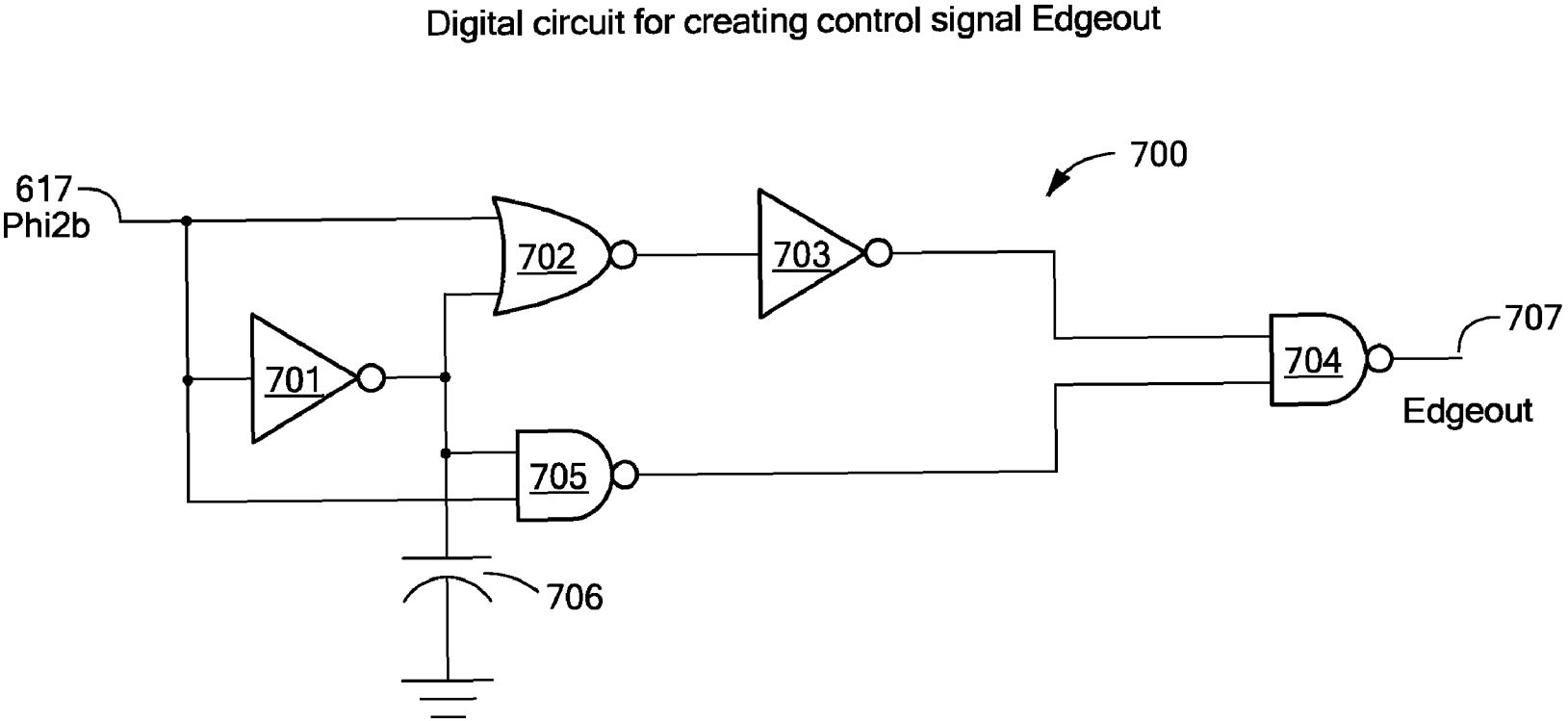
FIG. 7 is a schematic of a digital circuit for creating a pulsed signal.

FIG. 7 is a schematic of a digital sub-circuit 700 for creating pulsed digital signal Edgeout 707, also in response to the Switch Control input 614 going from low to high. Specifically, the transition of Phi2*b* 617 from high to low in the circuit 600 of FIG. 6(*a*) triggers the circuit 700 in FIG. 7. As described above, when the Switch Control input 614 is low and the circuit is in a steady state, Phi2*b* 617 will be high. As such, the output of nor gate 702 will be low, and the output of inverter 703 will be high, presenting a logic high to one input of nand gate 704. Similarly, in steady state the output of inverter 701 will present a logic low to a first input of nand gate 705, while Phi2*b* 617 presents a logic high to the other input of nand gate 705. Consequently, the output of nand gate 705 will be high. In this state, both inputs to nand gate 704 are high, so that the output of nand gate 704 (signal Edgeout 707) is low.

When Phi2*b* 617 transitions to logic low, the output of inverter 701 tries to go high, but that transition is delayed by the need to charge capacitor 706, so that the output of inverter 701 momentarily stays low. As such, the output of nor gate 702 goes high, and the output of inverter 703 goes low to provide a low input to one input of nand gate 704. Consequently, the output of nand gate 704 (signal Edgeout 707) transitions from low to high. Eventually, capacitor 706 is charged and the output of inverter 701 reaches logic high. Then, the output of nor gate 702 goes back to low, the output of inverter 703 goes back to high, thereby providing a logic high to the one input of nand gate 704. At the same time, nand gate 705 will have one input high and the other input low, so that the output of nand gate 705 will be high to provide a logic high to the second input of nand gate 704. As such, the output of nand gate 704 (signal Edgeout 707) returns to logic low. In summary, upon the transition of Phi2*b* 617 from logic high to logic low, Edgeout 707 briefly pulses logic high. The duration of the Edgeout 707 pulse will depend on how long it takes the output of inverter 701 to charge capacitor 706. The duration of the Edgeout 707 pulse will control the duration of the current boost supplied to a current mirror by transistor MN8 and transistor MN9, as described more fully below. The width of the Edgeout pulse is key to turning on the boost current source (through transistor MN8 and transistor MN9), and hence the time during which the switch arm 105 moves most rapidly towards making contact with stationary conductor 104.

Figure 8:
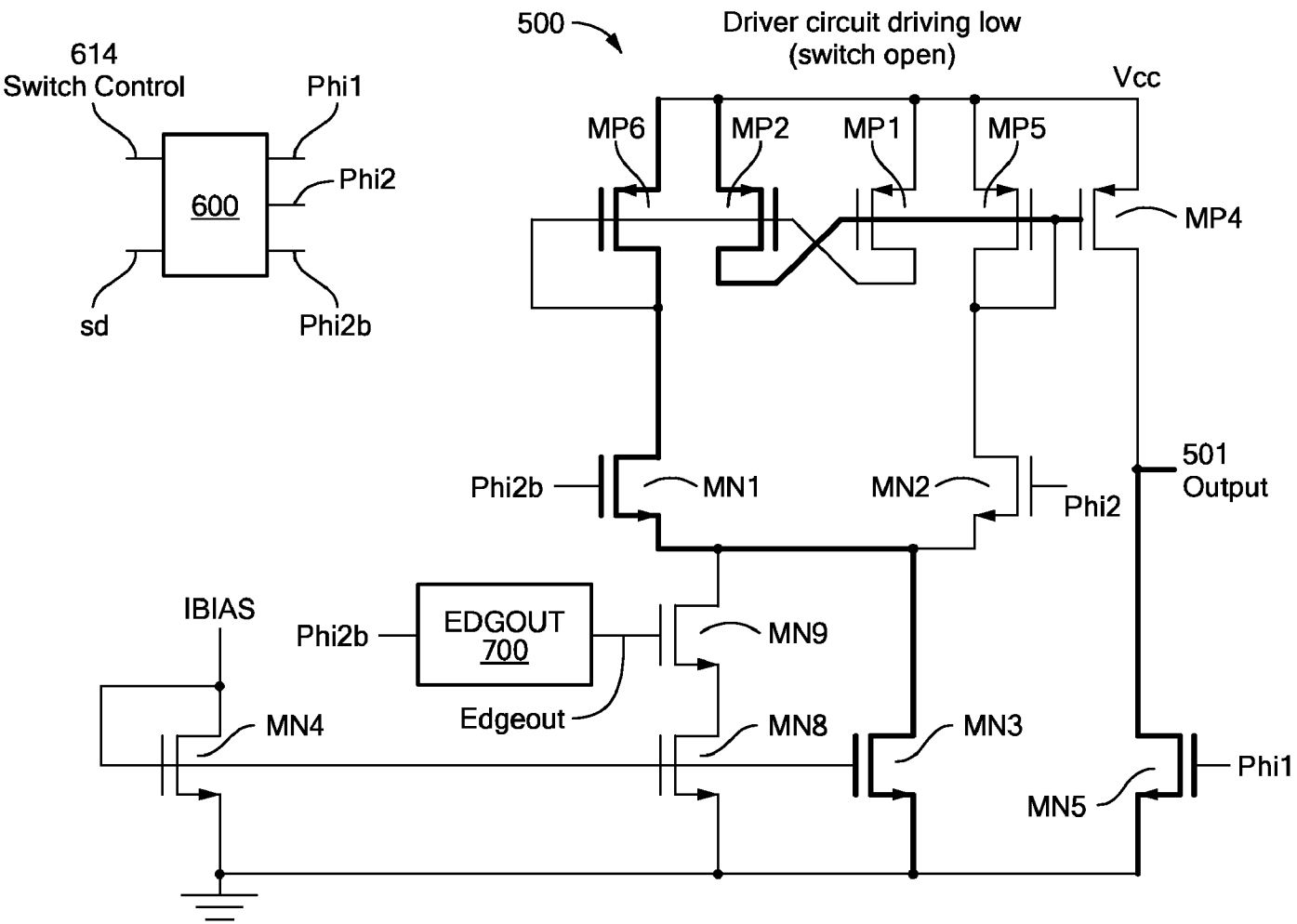
FIG. 8 is a schematic of the circuit in FIG. 5 showing certain features in a first operating state.

The operation of the circuit 500 as partially illustrated in FIG. 8 will now be discussed, beginning with the circuit in steady state, with the Switch Control input signal 614 low, leaving the switch open. As discussed above, in this state Phi1 615 is high, Phi2 616 is low, Phi2*b* 617 is high, and Edgeout 707 is low. A bias current of preferably 2 micro-Amperes flows through transistor MN4, which forms a current mirror with transistor MN8 and a second current mirror with transistor MN3. In this state, a portion of the bias current in transistor MN4 is mirrored in transistor MN3, producing a current of preferably 500 nano-Amperes. Because Edgeout 707 is low, no appreciable current flows in transistor MN9 or transistor MN8. Because Phi2 616 is low and Phi2*b* 617 is high, transistor MN2 is off (non-conducting) and transistor MN1 is on (conducting) so that all current flowing through transistor MN3 must also flow through transistor MN1. This current flow tends to pull the gates of transistor MP2 towards ground, causing transistor MP2 to electrically pull the gates of transistor MP1, transistor MP5 and transistor MP4 towards voltage rail (Vcc). As a result, transistors MP5 and MP4 are effectively non-conducting, so that transistor MP4 does not inject or sink current from the output node 501. At the same time, Phi2 616 high causes transistor MN5 to turn on (conducting), which drains charge on the switch gate 102 to ground via the output node 501, thereby depriving the switch arm 105 from any force to pull it downwards, and consequently the switch 100 is open.

Figure 9:
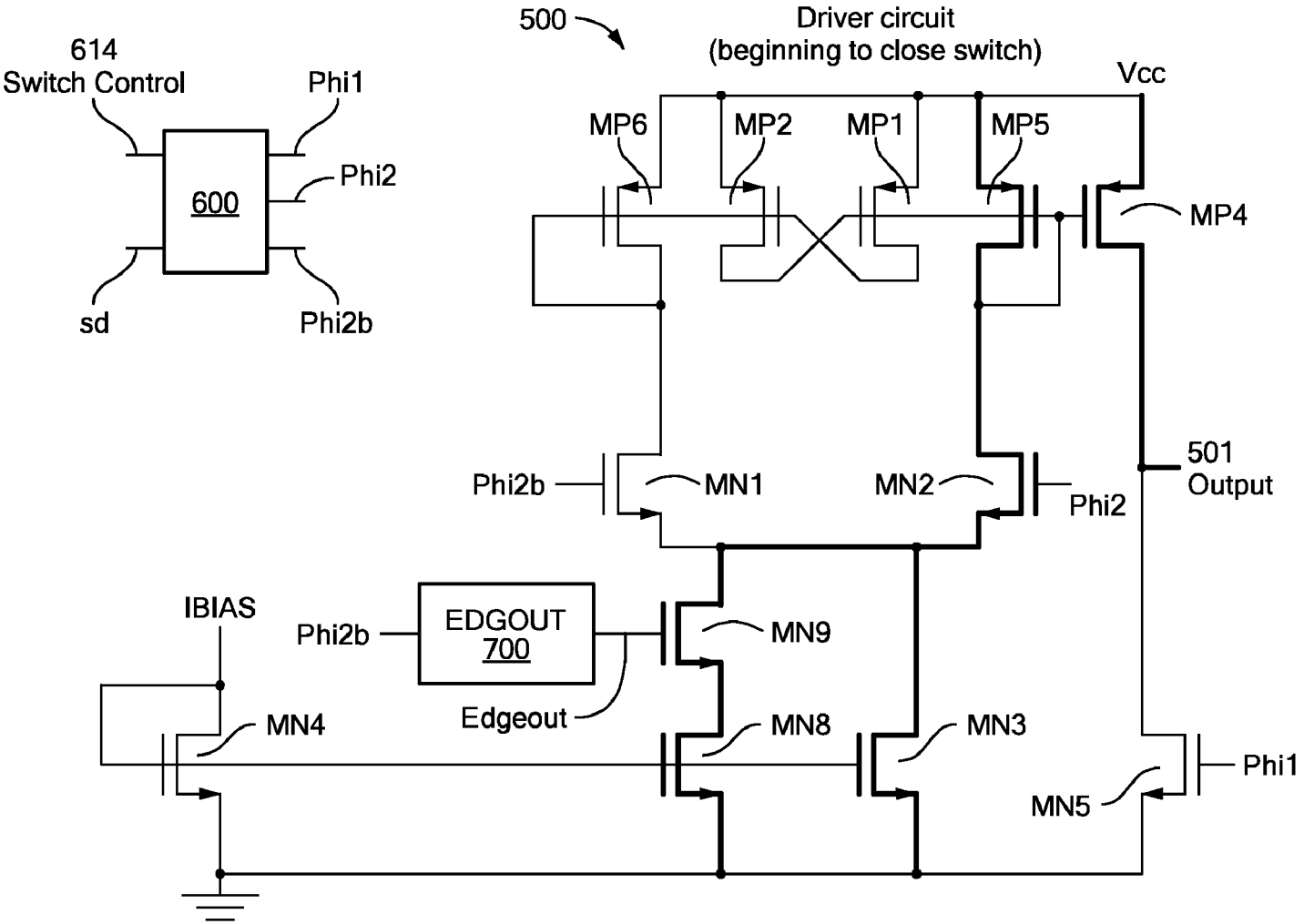
FIG. 9 is a schematic of the circuit in FIG. 5 showing certain features in a transitional state.

When the user wants to close the switch, the user causes the input Switch Control signal 614 to go high. As discussed above, this causes certain changes in control signals Phi1 615, Phi2 616, and Phi2*b* 617, and causes Edgeout 707 to pulse. The operation of the circuit 500 as partially illustrated in FIG. 9 will now be discussed. After the Switch Control signal 614 goes high, Phi1 615 will go low, thereby turning off transistor MN5, so that the gate electrode 102 of the switch is no longer shunted to ground. Initially, transistor MP4 remains off (non-conducting) so that there is no path for current to flow directly between Vcc and ground. The signals Phi1 615, Phi2 616 and Phi2*b* 617 are phased in time to assure that transistor MN5 and transistor MP4 are not conducting simultaneously. After a brief delay, Phi2 616 will go high and Phi2*b* 617 will go low, causing transistor MN2 to turn on (conducting) and transistor MN1 to turn off (non-conducting). Consequently, transistors MP5 and transistor MP4 also are released to conduct current. The current through transistor MN3 (preferably 500 nano-Amperes) is now forced to flow through transistor MN2, and therefore through transistor MP5. Transistor MP4 forms a current mirror with transistor MP5, with a gain of 4. It is known in the art to select a current mirroring transistor to provide a current gain, for example by making the mirroring transistor (in this case, transistor MP4) larger than the conducting transistor (in this case, transistor MP5). As a result, transistor MP4 conducts the amplified mirrored current (preferably 2 micro-Amperes) to the output node 501. The output node 501 is attached to the gate 102 of the switch, which is capacitive and acts to integrate the current flowing to it from the drive circuit, thereby causing the voltage on the gate 102 to ramp upwards (i.e., i=C dV/dt).

As also discussed above, the transition of the Switch Control 614 signal to logic high will cause Edgeout 707 to pulse to logic high. This will cause transistor MN9 to turn on (conducting), which will allow transistor MN8 to mirror a portion of the current in transistor MN4; preferably 2.5 micro-Amperes. The current in transistor MN8 will supplement the current in transistor MN3 that flows through transistor MN2, and the combined currents (preferably 3 micro-Amperes) will ultimately be amplified and mirrored by transistor MP4 to provide a current burst of 12 micro-Amperes to the output node 501. In turn, this causes the voltage on the switch gate 102 to ramp quickly toward the threshold voltage. Preferably the duration of Edgeout 707 is set to maintain this current flow until the voltage on the switch gate approaches the threshold voltage.

Figure 10:
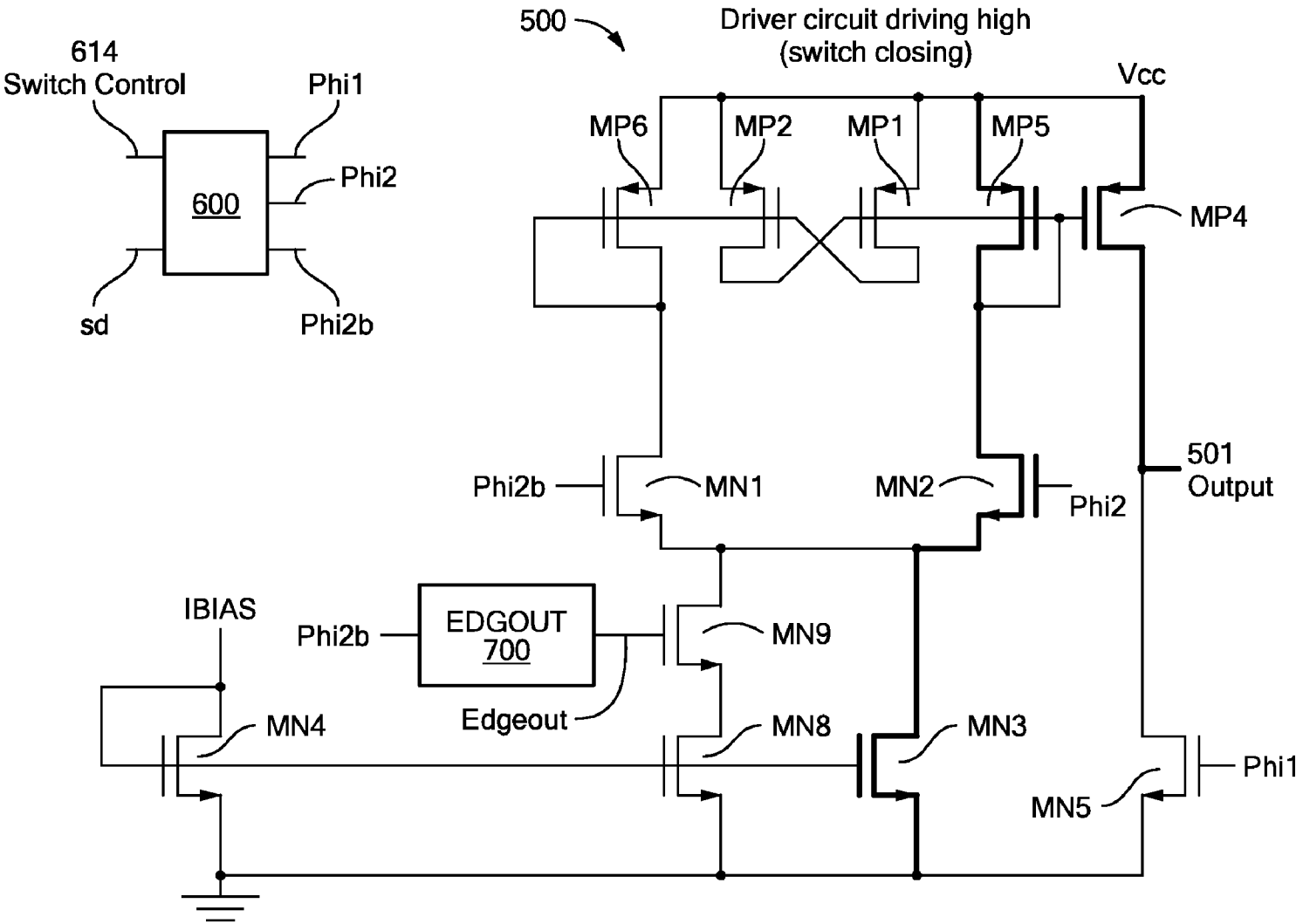
FIG. 10 is a schematic of the circuit in FIG. 5 showing certain features in a second operating state.

As further discussed above, the Edgeout 707 pulse will end, thereby turning off transistor MN9 (non-conducting). The operation of the circuit 500 as partially illustrated in FIG. 10 will now be discussed. In this state, the current in transistor MN3 is the only current being amplified and mirrored and provided to the output node 501. As such, the voltage on the switch gate will continue to ramp upwards, but now at a slower rate of change. At some point the voltage on the switch gate electrode exceeds the threshold voltage (Vth), at which time the switch arm makes contact with the drain electrode.

In accordance with the foregoing, the voltage on the switch gate electrode increases rapidly at the beginning, but then the voltage ramp slows. The voltage quickly reaches a point where it is strong enough to move the MEMS switch cantilever downward, which is important so that there is minimal lag time between the changing of the Switch Control 614 signal that commands the circuit to close the switch, and the actual closing of the switch. Later, the voltage on the switch gate increases more slowly, up to an ultimate voltage that is strong enough to hold the switch arm securely in the downward, closed position. Preferably the operation of the drive circuit will cause the arm to contact the drain electrode without bouncing or damaging the arm.

When the user desires to open the switch, the user will cause the Switch Control signal 614 to go low. The digital circuit discussed above will cause the driver circuit 500 to revert to the state discussed above in connection with FIGS. 6 and 8. As before, owing to the delays inherent in the timing generation circuit, the digital control signals Phi1 615, Phi2 615 and Phi2*b* 615 are phased in time to assure that transistor MN5 and transistor MP4 are not conducting simultaneously. As such, transistor MN5 will again drain the current from the switch gate electrode, thereby removing the force holding the arm in the downward, closed position, and allowing the switch to move back to the up, open circuit position.

Figure 11:
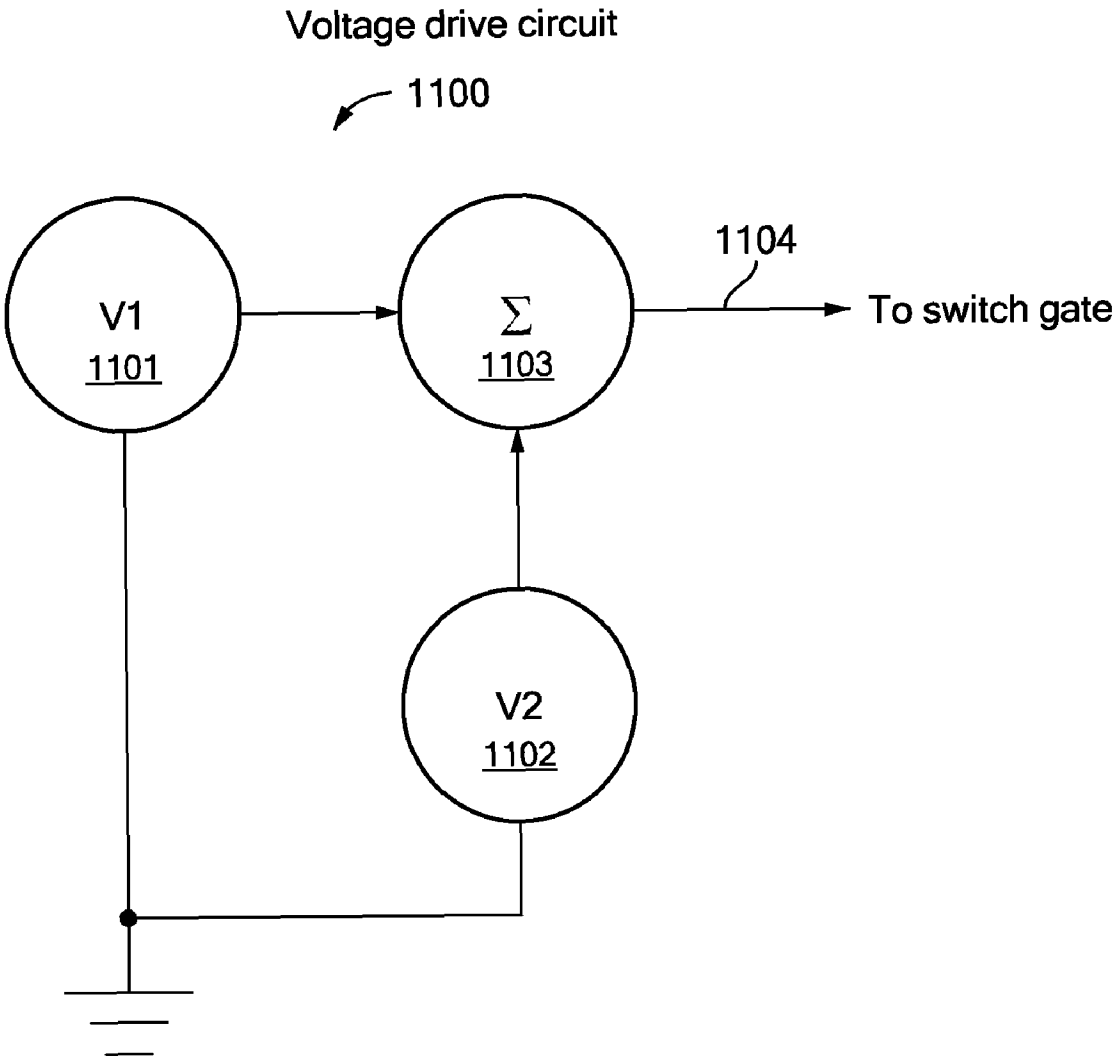
FIG. 11 is a schematic diagram of an illustrative embodiment of a circuit to drive the switch.

FIG. 11 is a schematic diagram of an alternate embodiment of a switch drive circuit. The switch drive circuit 1100 of FIG. 11 drives the switch with a voltage signal 1104. Voltage signal V1 1101 and voltage signal V2 1101 are both input to summing junction 1103. As is known in the art, the summing junction 1103 will sum voltage signal V1 and voltage signal V2 to produce voltage signal 1104. The level of voltage signal V1 and the level of voltage signal V2 combine to produce voltage signal 1104 having at least a first level and a second level. Voltage signal 1104 is then applied to the gate of the switch (not shown in FIG. 11) to control the operation of the switch. The level of voltage signal V1 and the level of voltage signal V2 are the rate of change of the respective voltages. The level of voltage signal V1 and the level of voltage signal V2 may change with time in order to produce the desired level of the voltage signal 1104.

Although the above discussion discloses various exemplary embodiments of the invention, it should be apparent that those skilled in the art can make various modifications that will achieve some of the advantages of the invention without departing from the true scope of the invention. The described embodiments are to be considered in all respects only as illustrative and not restrictive.

What is claimed is:

1. A method of driving a switch having a gate electrode adapted to receive a drive signal, a movable member and a stationary conductor, the movable member movable to make physical and electrical contact with the stationary conductor when the voltage on the gate electrode exceeds a threshold voltage, the method comprising:

applying a first fixed current signal to the gate electrode for a first period of time such that the charge delivered by the first fixed current signal produces a voltage on the gate electrode that is below the threshold voltage; and applying a second fixed current signal to the gate electrode for a second period of time, the charge delivered by the second fixed current signal providing a voltage on the gate electrode that is at or above the threshold voltage, wherein an electrostatic force is developed between the gate electrode and the movable member to close the switch.

2. The method as defined by claim 1, wherein the first current signal and the second current signal are applied sequentially.

3. The method as defined by claim 1, wherein the first current signal and the second current signal are applied substantially simultaneously.

4. The method as defined by claim 1, wherein:

the first current signal has a first fixed amplitude; and the second current signal has a second fixed amplitude, wherein the second amplitude is less than the first amplitude.

5. A method of driving a switch according to claim 1 wherein the movable member moves to electrically connect with the stationary conductor when subjected to a threshold electrostatic force, the first current signal causing an electrostatic force that is less than the threshold electrostatic force.

* * * * *